United States Patent [19]

Shaffer

[11] Patent Number: 4,655,526

[45] **Date of Patent: * Apr. 7, 1987**

[54] LIMITED INSERTION FORCE CONTACT TERMINALS AND CONNECTORS

[75] Inventor: Howard R. Shaffer, Millersburg, Pa.

[73] Assignee: AMP Incorporated, Harrisburg, Pa.

[ * ] Notice: The portion of the term of this patent subsequent to May 27, 2003 has been disclaimed.

[21] Appl. No.: 823,849

[22] Filed: Jan. 29, 1986

Related U.S. Application Data

[63] Continuation of Ser. No. 646,554, Aug. 31, 1984, Pat. No. 4,591,222.

[51] Int. Cl.[4] ..... H01R 13/62

[52] U.S. Cl. ..... 339/74 R; 339/176 M; 339/176 MP:252 P; 339/258 R

[58] Field of Search ..... 339/74 R, 75 R, 75 M, 339/75 MP, 176 M, 176 MP:252 P, 258 R, 258 F, 258 P

[56] References Cited

U.S. PATENT DOCUMENTS

| | | | |
|---|---|---|---|
| 1,454,879 | 5/1923 | Zöllner | 339/253 S |
| 2,014,056 | 9/1935 | Van Noorden | 173/303 |
| 2,063,718 | 12/1936 | Berndt | 173/303 |
| 2,078,051 | 4/1937 | Berndt | 173/303 |
| 2,711,523 | 6/1955 | Willis | 339/253 |
| 2,724,096 | 11/1955 | Klostermann | 339/255 |
| 3,241,204 | 3/1966 | Baricevic et al. | 24/126 |
| 3,300,752 | 1/1967 | Benoit et al. | 339/253 |
| 3,350,680 | 10/1967 | Benoit et al. | 339/253 |
| 3,368,186 | 2/1968 | Benoit et al. | 339/253 |
| 3,555,487 | 1/1971 | Jones | 339/60 |
| 3,899,234 | 8/1975 | Yeager et al. | 339/74 R |
| 3,903,385 | 9/1975 | Moyer et al. | 339/176 MP |
| 3,980,377 | 9/1976 | Oxley | 339/75 MP |
| 4,105,280 | 8/1978 | Thompson, Jr. | 339/273 S |
| 4,118,094 | 10/1978 | Key | 339/75 MP |
| 4,274,694 | 6/1981 | Leather | 339/74 R |
| 4,397,519 | 8/1983 | Cooney | 339/255 R |
| 4,453,794 | 6/1984 | Wallner et al. | 339/907 |
| 4,591,222 | 5/1986 | Shaffer | 339/74 R |

FOREIGN PATENT DOCUMENTS

| | | | |
|---|---|---|---|
| 72723 | 4/1960 | France | 339/75 MP |
| 1288813 | 2/1962 | France . | |

OTHER PUBLICATIONS

"Data Sheet No. 73-194", Revised 1-74, AMP Incorporated Type III(+) Contacts.

*Primary Examiner*—John McQuade
*Attorney, Agent, or Firm*—Anton P. Ness

[57] ABSTRACT

A passive cam follower comprising a bracing means and a compression means is provided for an electrical article (such as an active socket terminal) having spring contact arms, which holds the spring contact arms in a spring biased position for mating with another electrical article (such as a pin terminal) requiring subtantially lessened insertion force. Upon mating the bracing means is urged away from the spring contact arms by the mating article and into a compressed state. Upon withdrawal of the mating article the bracing means is urged forward by the compressed compression means and follows the mating article and resumes its original bracing position relative to the spring contact arms. The bracing means may be a compression spring and have a cap on the forward end and may be a coil spring or an integral molded plastic spring. In a card edge connector a bracing means may be disposed in the card-receiving cavity and comprise an integral molded plastic spring. In an active pin terminal, the passive cam follower may be a coaxially disposed coil compression spring holding together the spring contact arms comprising the pin contact section, and the spring may have a collar on the forward end thereof. Other embodiments are directed toward socket terminals having a single spring contact arm, single-sided card edges connectors having only one row of spring contact arms, and multi-contact pin/-socket connectors having sockets each utilizing one spring contact arm.

3 Claims, 18 Drawing Figures

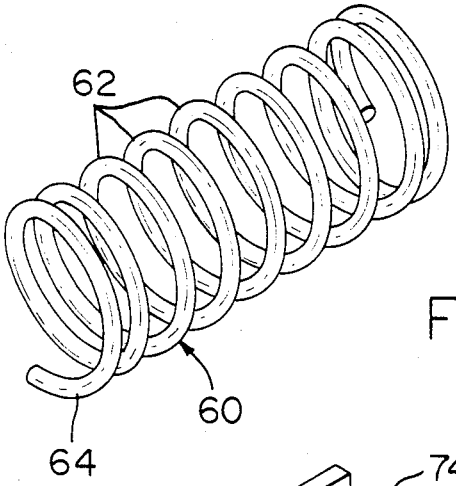
FIG. 6
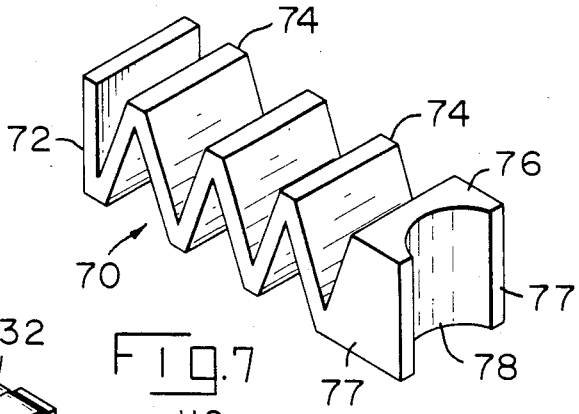
FIG. 7
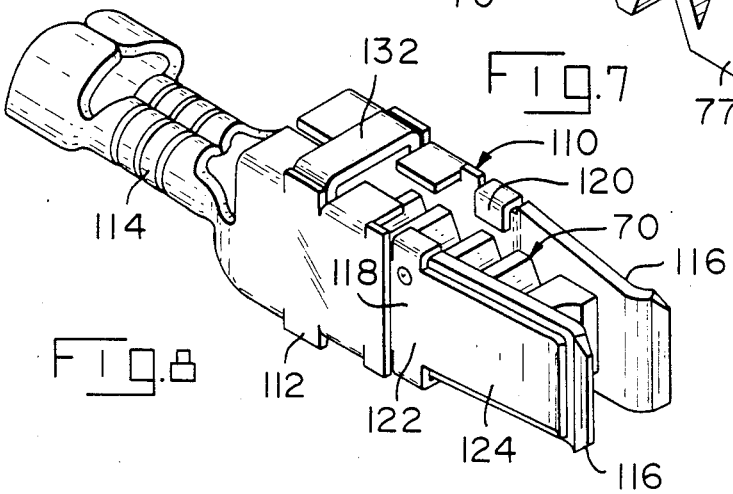
FIG. 8
FIG. 9
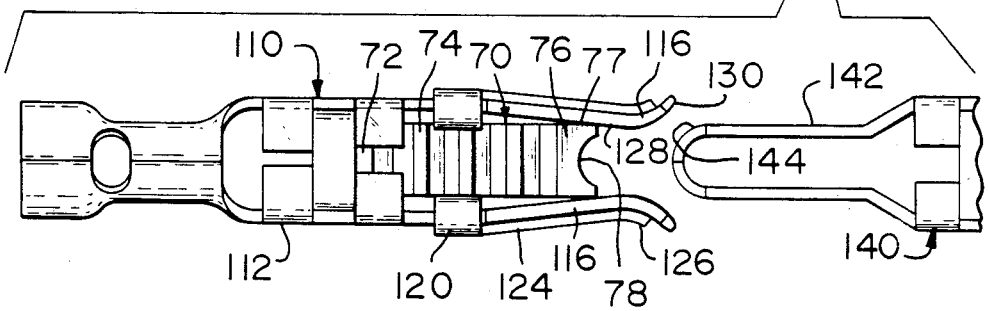

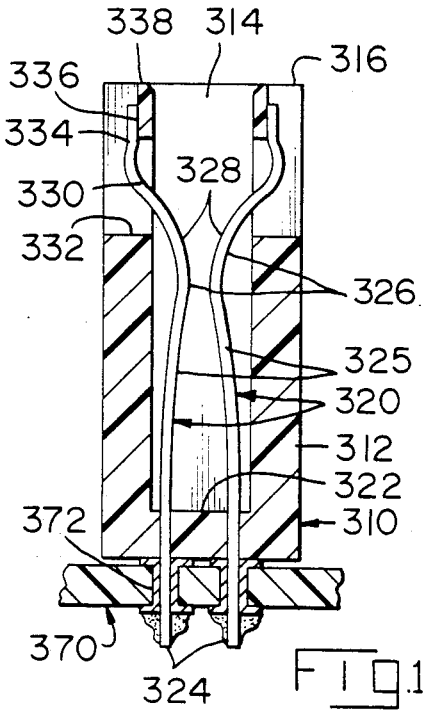
FIG.15
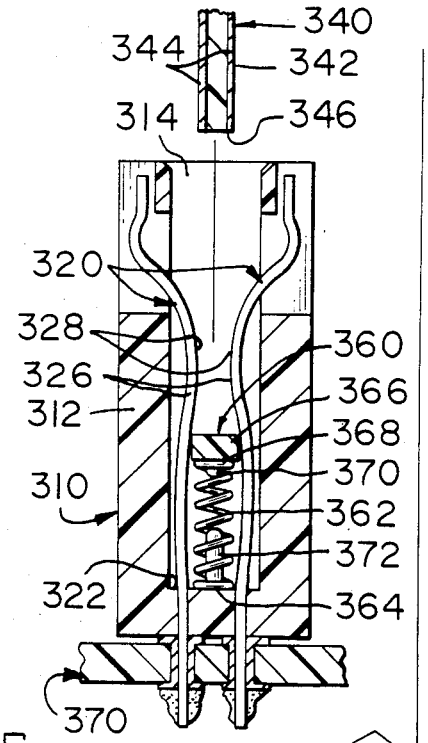
FIG.16
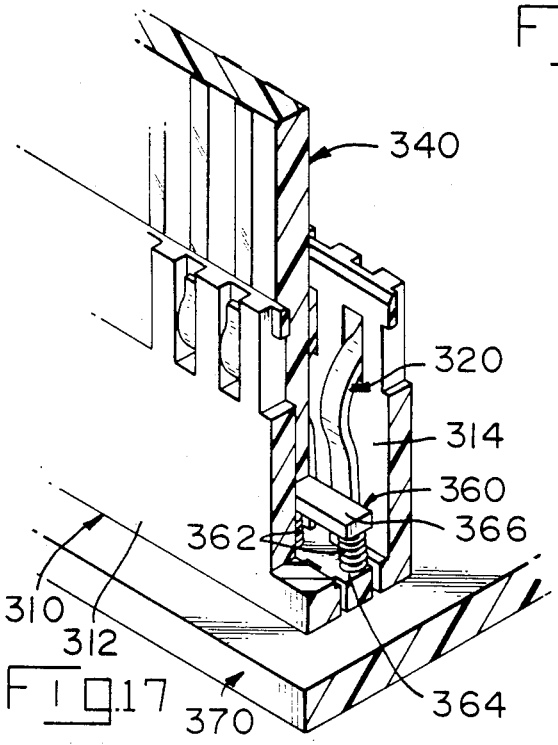
FIG.17
FIG.18
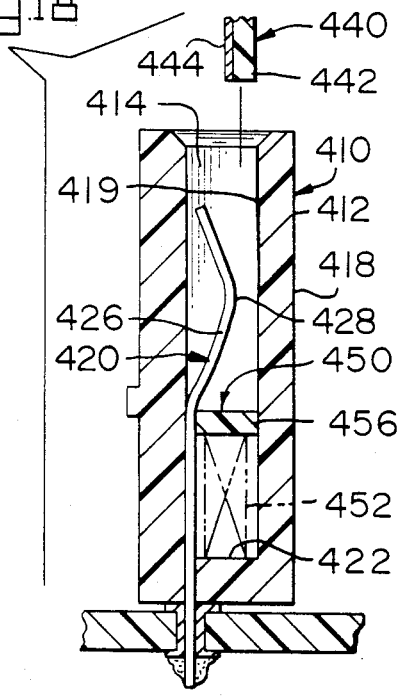

LIMITED INSERTION FORCE CONTACT TERMINALS AND CONNECTORS

This is a continuation of application Ser. No. 646,554 filed Aug. 31, 1984 now U.S. Pat. No. 4,591,222.

FIELD OF THE INVENTION

The present invention relates to the field of electrical connectors, and more particularly to male and female terminals and connectors such as card-edge connectors.

BACKGROUND OF THE INVENTION

An effective electrical connection between a receptacle terminal and a mating plug terminal, such as a socket and pin, is achieved when there is substantial contact force by the contact areas of the receptacle terminal applied normally to corresponding contact areas of the plug terminal when the plug terminal has been fully inserted into the receptacle terminal. A typical active socket terminal has cantilever spring arms having stiff spring characteristics, which arms must be urged apart by the pin terminal during insertion. The force required to insert the pin into the socket, termed the insertion force, may be on the order of 1½ lbs. Where an electrical plug connector has many such pins and is to be mated with a corresponding socket connector the total mating force is the sum of the individual insertion forces; for instance, in a connector having fifty terminals, each with an insertion force of 1½ lbs., the total mating force would be 75 lbs. With such a high mating force required, unassisted manual connection is difficult.

Card edge connectors are known to electrically connect two opposing rows of spring contact arms of discrete contacts to conductors on side surfaces of an edge portion of a printed circuit card. So many pairs of spring contact arms are located in such a connector each having an insertion force presenting a significant overall insertion force required to be overcome to insert a card edge, that many designs of ZIF (zero insertion force) or LIF (low insertion force) connectors have been devised. Usually such connectors utilize a distinct operator actuated camming device having an active position to force the paired spring contact arms apart and hold them apart until the card edge has been inserted therebetween at little or no insertion force, after which the camming device is actuated to a neutral position allowing the spring contact arms to apply significant contact force normally against the respective conductors on the side surface of the card edge. One such connector is disclosed in U.S. Pat. No. 3,899,234. Such operator actuation is a separate step requiring either significant manual effort or appropriate separate tooling, or both.

SUMMARY OF THE INVENTION

The present invention provides a mechanism allowing for substantial reduction in the insertion force of a pin terminal into a socket terminal or a card edge into a card edge connector, for example. The present invention comprises a compressible passive cam follower associated with spring contact arms of a first electrical article such as a socket terminal, having a bracing means holding the arms in a spring biased condition to facilitate mating with a second electrical article. During mating, the second article pushes the bracing means away from engagement with the spring contact arms and into a compressed state. Upon removal of the second article, the bracing means follows the second article and resumes its position to again hold the spring contact arms of the first article in a spring biased condition. The passive cam follower may be a coil spring with or without a cap member as the bracing means, or it may be an integral molded plastic spring, for example.

In one embodiment a low strength compression spring is securely contained within the socket cavity of a circular socket terminal, axially aligned therein and having an outer diameter larger than the inner distance between the contact areas of opposing contact arms of the socket when the arms are not spring biased apart, but less than the general inner diameter of the socket cavity distant from the contact areas. With a rearward end of the spring stopped against the inner end or stop surfaces of the socket cavity, the spring has a length when only slightly compressed such that the forward end of the spring extends forwardly almost to the contact areas of the contact arms. When disposed to be so extended, the forward end of the spring is a bracing means holding apart the contact arms in a spring biased condition. When a mating pin terminal is then inserted, it will engage the forward end of the compression spring and begin to compress it, which allows the socket's contact arms to tend to move together until they engage the sides of the now-partially inserted pin terminal, thus substantially reducing the initial insertion force to the much-lower compression strength of the compression spring plus the frictional forces between the contact surfaces. And as the pin terminal is being later removed, the compression spring being under compression will thus be allowed to extend forward; when the end of the pin terminal is about to completely exit the socket, but while still holding the socket contact arms apart, the forward end of the spring will have already resumed its bracing position holding the socket contact arms apart until a pin terminal is next inserted thereinto. Especially in larger-sized or high contact force contact terminals a cap may be secured to the forward end of the compression spring and comprise the bracing means.

In another socket embodiment, a socket terminal has a single cantilever spring contact arm extending into a slot in a side of the socket cavity, where the socket cavity is of a socket terminal member and the spring contact arm is on a separate member secured around the socket terminal member. A passive cam follower can be contained within the socket cavity similarly to the embodiment above, to spring bias the single spring contact arm by bracing against the opposing socket cavity wall.

In another embodiment, a receptacle terminal has two opposing flat cantilever spring contact arms to receive a blade-like plug contact of a plug terminal therein. A compression spring is secured within the terminal between the spring contact arms with a cap in a bracing position holding apart the contact arms in a spring biased condition. The blade-like plug contact pushes the cap upon insertion compressing the spring and moving the cap from between the spring contact arms which now engage the sides of the partially inserted plug contact. Upon removal of the plug contact the compression spring will extend forward and the cap will resume its bracing position holding apart the spring contact arms.

In another embodiment, a compression spring may be secured coaxially around the outside of an active pin terminal, the forward end thereof being a bracing means holding together the spring arms of the active pin terminal, thus providing a narrow effective diameter for the pin contact section. Upon insertion of the pin contact arms into a barrel of a socket terminal, the forward end of the socket barrel will engage the forward end of the compression spring, pushing it back along the pin contact arms into a compressed state, and allowing the pin contact arms to tend to assume their unstressed state and move apart until they engage the inside contact surfaces of the socket barrel. Upon withdrawal of the pin terminal from the socket, the forward end of the compression spring will be allowed to extend forward while the forward end of the socket barrel still holds together the pin contact arms, and will resume holding the pin's contact arms together upon complete removal of the socket terminal from around the active pin terminal.

In an embodiment useful particularly in connectors receiving edge portions of printed circuit cards, an integral molded plastic compression spring is securely disposed within and adjacent the bottom of a card-receiving cavity having opposing rows of contact arms of electrical contacts which are to electrically engage respective conductors on a printed circuit card edge insertable into the cavity. The compression spring is disposed between the two rows of contacts and is compressible in the vertical direction. Such opposing contact arms are to extend substantially into the cavity when unbiased and must be urged apart by the edge of the printed circuit card being inserted therebetween. With such a plurality of electrical contacts the sum of the insertion forces rises to a significant level, requiring a total mating force higher than can be effectively met by unassisted manual effort. At the forward end of the compression spring, according to the present invention, is an integral cap comprising the bracing means. The cap holds apart the contact arms until a printed circuit card edge is begun to be inserted thereinto, physically engaging the cap and compressing the compression spring until the card edge is fully inserted, at which time the opposing contact arms will apply their designed contact force against respective conductors on the surfaces of the card edge. Upon withdrawal of the card edge, the cap is urged upward to resume its bracing position holding apart the spring contact arms.

In an alternate embodiment of card edge connector, a selected pair or group of pairs of opposing spring contact arm sections has its own compression spring and individual cap associated therewith.

In yet another embodiment, a multi-contact receptacle connector may comprise a plurality of single spring contact arms each of which extends toward or against when unbiased an associated opposing wall of the connector housing, such as an individual cavity wall, to apply contact force against a blade-like plug terminal or a post terminal inserted between the single spring contact arm and the housing wall. A passive cam follower of the invention could be disposed between each of the single spring contact arms and the housing wall, similarly to the card edge connector embodiments above. Such an arrangement is also useful for single-sided card edge connectors requiring only a single row of aligned spring contact arms in a card-receiving cavity.

BRIEF DESCRIPTION OF THE DRAWINGS

FIG. 6 is a perspective view of a coil spring passive cam follower not requiring a cap.

FIG. 7 is a perspective view of a molded plastic spring passive cam follower.

FIG. 8 is a perspective view of a receptacle terminal with a passive cam follower therein.

FIG. 9 shows a plan view of the receptacle terminal of FIG. 8 and a plug terminal insertable thereinto.

FIG. 15 is a cross-section view of the card edge connector of FIG. 11 without a passive cam follower therein.

FIG. 16 is a cross-section view of the connector of FIG. 15 with a passive cam follower therein.

FIG. 17 is a perspective section view similar to FIG. 14 with the passive cam follower of FIG. 16 therein.

FIG. 18 is a cross-section view of a card edge connector for single-sided card edges.

DETAILED DESCRIPTION OF THE PREFERRED EMBODIMENTS

The bracing means or passive cam follower of the present invention has different preferred embodiments depending upon the nature of the terminal or connector with which it is desired to be used, to substantially reduce the insertion force during electrical connection with a mating terminal, connector or card edge.

Figures 1, 2:
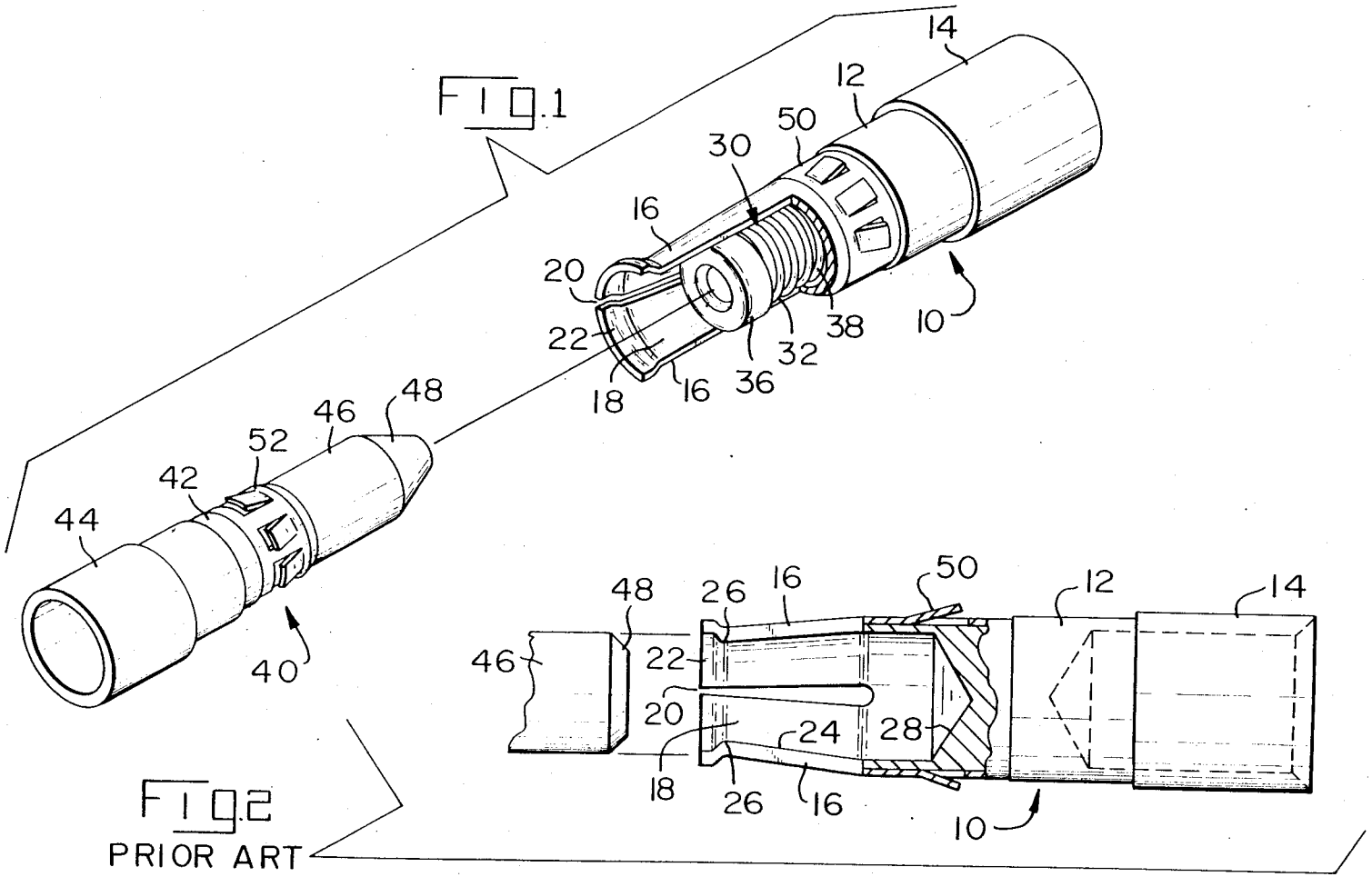
FIG. 2 PRIOR ART
FIG. 1 is a perspective view of an active socket terminal with contact arms broken away, illustrating a passive cam follower of the present invention, and a pin terminal insertable therein.
FIG. 2 is a longitudinal section view of an active socket terminal of the prior art.

FIG. 1 illustrates an active socket terminal 10 matable with a pin contact 40. Socket terminal 10 has body section 12, conductor-connecting section 14 (crimpable, solderable or weldable to a stripped end of a conductor), and arcuate converging spring contact arms 16 extending forward from body section 12 and defining a socket cavity 18. Contained within cavity 18 is the passive cam follower 30 of the present invention comprising: a stop means, rearward end 38; a compression means, coil compression spring 32; and at a forward end 34 thereof a bracing means, cap member 36. Spring contact arms 16 have narrow slits or gaps 20 therebetween extending from forward end 22 of the terminal substantially to body section 12. Pin terminal 40 has a body section 42, conductor-connecting section 44, and pin contact section 46 having a forward end 48. Both terminals 10, 40 have respective retention means 50, 52 which may be circumferential spring clips having projections extending outwardly and rearwardly therefrom to engage respective stop shoulders along terminal-receiving passageways of dielectric connector housing members (not shown) to retain the terminals therein.

FIG. 2 illustrates the active socket terminal of FIG. 1 without the passive cam follower of the present invention. A forward end 48 of pin contact section 46 of pin terminal 40 has a beveled circumferential surface and is positioned to be inserted between the spring contact arms 16 to electrically engage socket terminal 10. Forward end 22 of socket terminal 10 has a formation constituting a lead-in for enabling insertion of pin contact section 46, formed by forward ends of spring contact arms 16 diverging or extending outwardly a small distance. During insertion of pin contact section 46, forward pin end 48 will enter forward socket end 22 and engage inside surface 24 of spring contact arms 16 at initial engagement points 26 which are those points of inside surfaces 24 of converging spring contact arms 16 (annular within socket cavity 18) which would be closest to each other if arms 16 were in an unbiased or unstressed position as shown in FIG. 2. The active socket terminal 10 is formed so that the distance between points 26 is less than the diameter of pin contact section 46 of a mating pin terminal 40 if the spring contact arms 16 would be unbiased, and the forward ends of spring contact arms 16 would have to be urged apart by pin contact section 46 during insertion. This action places spring contact arms 16 under bias to establish requisite contact force between inside surfaces of spring contact arms 16 and the sides of pin contact section 46 to assure integrity of the electrical connection of the two mating terminals.

The force needed to insert pin contact section 46 into socket cavity 18 and urge apart spring contact arms 16 is termed the insertion force. Pin contact section 46 urges apart spring contact arms 16 and then is fully inserted into socket cavity 18 when forward pin end 48 nears bottom end 28 of socket cavity 18. During full insertion pin contact section 46 frictionally engages now substantially parallel inside surfaces 24 of spring contact arms 16, and the force needed to overcome this friction is termed the separation force which is typically substantially less than the insertion force and is equal to the force needed to withdraw pin contact section 46 from socket cavity 18. A typical active socket terminal useful for power conducting could be a standard Size No. 8. Typical values for mating a pair of Size No. 8 pin and socket terminals 40, 10 would be: an insertion force of 4½ lbs.; a separation force of 2 lbs.

Figure 3:
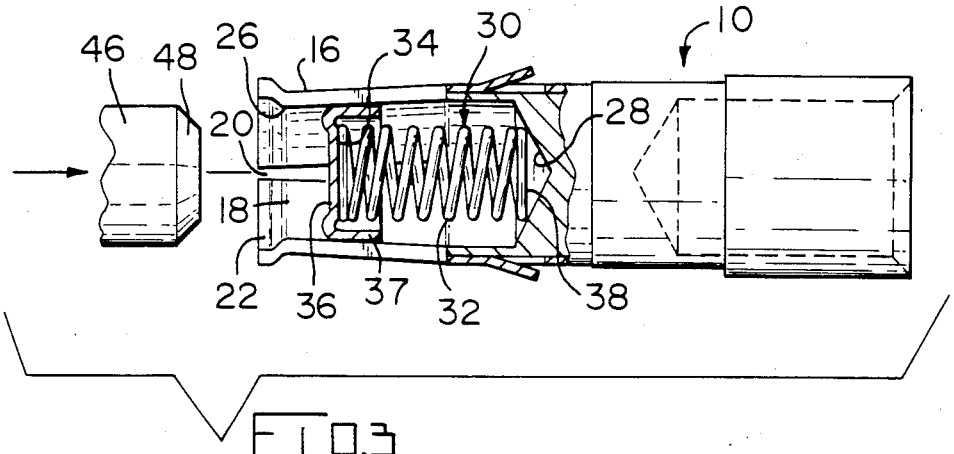
FIGS. 3–5 are part longitudinal section views of the active socket terminal of FIG. 1, with a pin terminal ready for insertion therein, fully inserted, and being withdrawn therefrom respectively.
Figure 4:
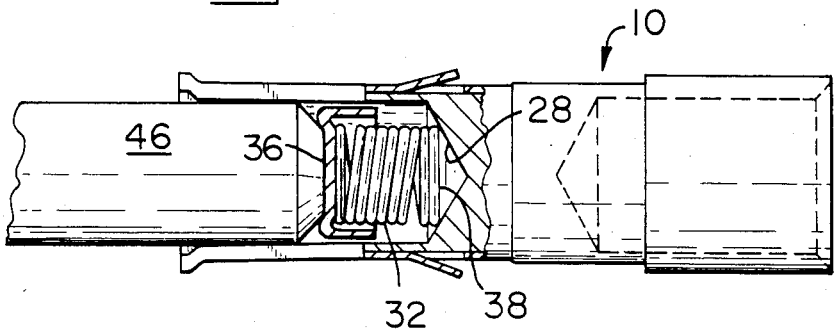
Figure 5:
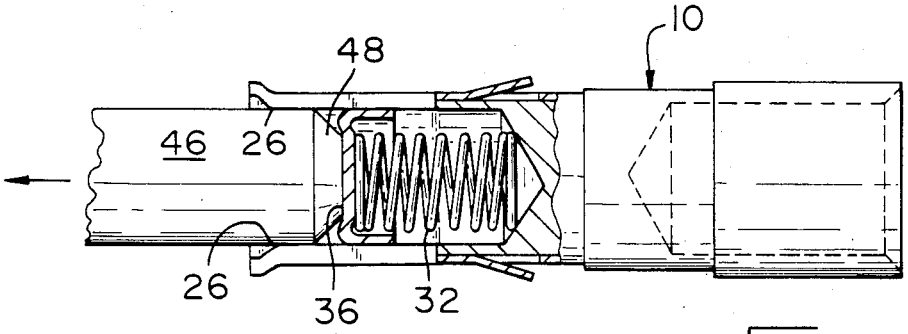

FIGS. 3, 4 and 5 illustrate the action of the passive cam follower 30 of the present invention in active socket terminal 10 of FIGS. 1 and 2 during insertion and withdrawal of pin contact section 46 into and from socket cavity 18. To facilitate explanation of the present invention, reference is first made to FIG. 4 showing pin contact section 46 fully inserted into socket cavity 81. Passive cam follower 30 is under compression, with cap member 36 at forward end 34 of compression spring 32 engaged by forward end 48 of the pin terminal, and rearward end 38 of compression spring 32 abutting bottom end 28 of socket cavity 18. Cap member 36 has an outer diameter approximately equal to the diameter of pin contact section 46. Spring contact arms 16 of socket terminal 10 are in a biased position, held apart by pin contact section 46.

As shown in FIG. 5, as pin contact section 46 is withdrawn from socket cavity 18 and while a forward portion of the pin still biases spring contact arms 16 apart, compression spring 32 will urge cap member 36 forward to remain in engagement with forward pin end 48. As forward pin end 48 is about to be withdrawn past initial engagement points 26, cap member 36 has followed pin end 48 until it is disposed near to points 26. Upon complete withdrawal, spring contact arms 16 then no longer are held apart by pin contact section 46 but are held apart now by side portions 37 of cap member 36, as shown in FIG. 3, and thus do not return to an unbiased or unstressed position, as shown in FIG. 2.

As shown in FIG. 3, spring contact arms 16 are now held apart in a biased position by cap member 36 acting as a bracing means or strut, ready for the next insertion of pin contact section 46 and do not require the substantial amount of insertion force which would otherwise be required to urge them apart from an unbiased position. Passive cam follower 30 can be disposed in its bracing position during manufacture of the terminal simply by utilizing a pin-shaped tool (not shown) inserted into, then withdrawn from the active socket terminal 10 after follower 30 has been placed into (and secured within, if desired) socket cavity 18.

Compression spring 32 is selected to have a low compression strength, just enough to overcome slight resistance of a properly dimensioned cap member 36 moving along inside the surfaces 24 of spring contact arms 16 as it nears initial engagement points 26. Compression spring 32 need only have a diameter less than the inside diameter of cap member 36 but large enough for rearward end 38 to abuttingly engage a cooperating stop means such as bottom cavity end 28 proximate side walls of the cavity; and have a length such that compression spring 32 is under slight compression when passive cam follower 30 is in its bracing position, as shown in FIG. 3, so that compression spring 32 is not loose nor easily vibrated loose within socket cavity 18. Rearward end 38 may alternatively be secured to bottom cavity end 28 such as by welding, soldering or potting.

Cap member 36 should be formed of such a material (i.e., stainless steel) and have such a structure as to be stiffly resistant to the inward spring (contact) force of spring contact arms 16, be only touchingly engageable with forward pin end 48, and maintain longitudinal stability by engaging surfaces 24 along sufficient length with side portion 37. Cap member 36 may be fastened to forward end 34 of spring 32 or may optionally be held between compression spring 32 under at least slight compression and either by the pin when mated with the socket, or by the spring contact arms when unmated.

A typical compression strength for a compression spring 32 usable with the Size No. 8 active socket terminal 10 of FIGS. 1 through 5, would be ½ lb. Thus, a typical value for the insertion force in the example of FIGS. 3 through 5 would be equal to the separation force plus the spring compression strength, or 2 lbs. plus ½ lb. which equals 2½ lbs. This amount is substantially less than the typical value of 4½ lbs. insertion force without using the passive cam follower of the present invention.

FIG. 6 illustrates an alternative embodiment of the passive cam follower of the present invention comprising a coil compression spring 60 of stainless steel, for example, where several closely-spaced foward ones of coils 62 at forward end 64 comprise the bracing means of the passive cam follower eliminating the need for a cap member. Such a spring 60 is usable in smaller active socket terminals having less inward spring (contact) force and may have lower compression strength than spring 32. Such a spring 60 could have forward ones of coils 62 be of a larger diameter than the remaining coils.

FIG. 7 illustrates an alternate embodiment of the passive cam follower comprising an integral molded plastic spring 70 of polyetherimide, for example, having a stop means, end 72; a compression means, accordion structure 74; and a bracing means, forward end 76 having side portions 77 and a plug engagement section 78. Such a passive cam follower 70 is used in FIGS. 8 and 9.

In FIGS. 8 and 9, a receptacle terminal 110 is shown having a body section 112, a conductor-receiving section 114 (crimpable around a stripped end of a conductor), a pair of opposing cantilever spring contact arms 116 and an assist spring 118 as described with more particularity in U.S. patent application Ser. No. 625,998 filed June 29, 1984. Used as a power connector with plug terminal 140, receptacle terminal 110 has its contact force enhanced by assist spring 118 if terminal 110 is made of softer high copper content alloy for better electrical conductivity. Assist spring 118 may be made of stainless steel, secured to body section 112 by tabs 120, and has a bridge section (not shown) extending under terminal 110 which is integral with base portions 112 of assist spring arms 124.

As shown in FIG. 9, forward ends 126 of assist spring arms 124 engage outside surfaces of spring contact arms 116 proximate points 128 at which plug contact section 142 of plug terminal 140 initially engages spring contact arms 116. Forward receptacle end 130 comprises a lead-in for rounded forward plug end 144 of plug contact section 142. A retention means 132 is secured within receptacle terminal 110 to engage stop shoulders in a terminal-receiving passageway of a dielectric connector housing (not shown) for terminal 110.

Passive cam follower 70 is the type shown in FIG. 7. End 72 is preferably secured to or held against cooperating stop surfaces (not shown) located either on body section 112 of socket terminal 110 or on retention means 132 extending axially normally across body section 112 therewithin (not shown). With passive cam follower 70 already in an extended position with its forward end 76 disposed as a brace or strut between and holding apart spring contact arms 116 near points 128, receptacle terminal 110 is prepared for the insertion of plug contact 142 therein. Since spring contact arms 116 are already in a biased parted position, substantially lowered insertion force is required to insert plug contact section 142 therebetween. End 144 will engage forward plug engagement section 78 and begin to compress compression means 74 until the plug is fully inserted. When the plug is withdrawn, compression means 74 will urge forward end 76 forward until side portions 77 of forward end 76 are engaged by inside surfaces of spring contact arms 116, which will now be held apart by forward end 76 until plug contact section 142 is next inserted.

Figure 10:
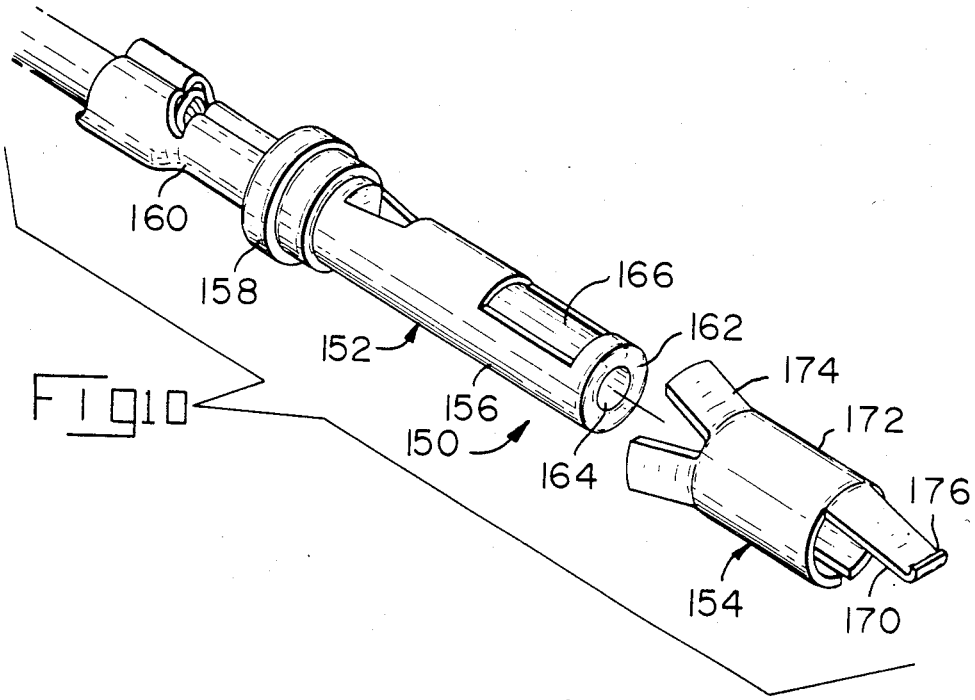
FIG. 10 is a perspective exploded view of a two part socket terminal having a single spring contact arm.
Figure 11:
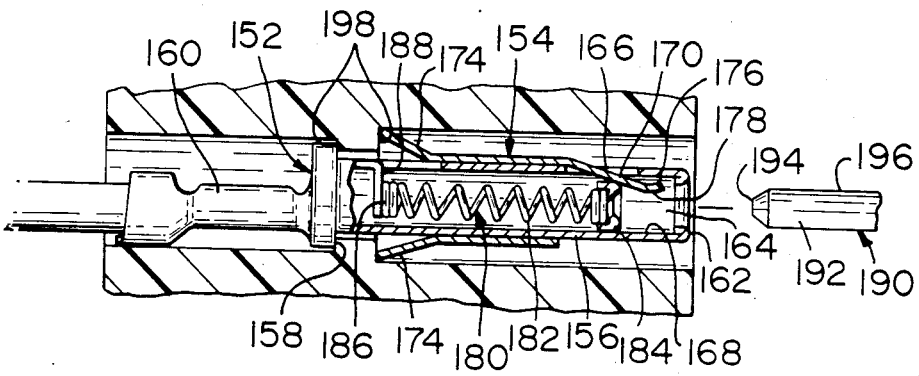
FIG. 11 is a longitudinal section view of the socket terminal of FIG. 10 with a passive cam follower therein.

A circular active socket terminal 150 is shown in FIGS. 10 and 11 wherein there is only one cantilever spring contact arm. FIG. 11 illustrates terminal 150 with a passive cam follower 180 therein and a pin terminal 190 insertable thereinto. A typical terminal 150 would be quite similar to a Type III (+) socket contact such as that sold by AMP Incorporated of Harrisburg, Penn. As shown in FIG. 10 such a contact is comprised of a socket barrel article 152 and a sring contact article 154. Socket barrel article 152 has a barrel section 156, a stop shoulder 158 and a conductor-receiving section 160. Barrel section 156 has a bell mouth or lead-in 162, a socket cavity 164, a spring arm-receiving aperture 166 and an opposing cooperating surface 168. Spring contact article 154 has a spring contact arm 170, a body section 172 and retention projections 174. Article 154 is secured around barrel section 156 of article 152 such that spring contact arm 170 extends through aperture 166 into socket cavity 164 and has a short outwardly extending forward end 176 forward of contact surface 178, forward end 176 underlying a portion of barrel section 156 forward of aperture 166 when assembled.

As shown in FIG. 11 such a terminal 150 is secured within a terminal-receiving passageway of connector housing, held by stop shoulder 158 and retention projections 174 engaging cooperating stop shoulders 198 of the passageway. Passive cam follower 180 is disposed within socket cavity 164 and has a compression spring 182 and a cap member 184 at a forward end thereof, with a rearward end 186 of spring 182 engaging a cooperating stop means 188 such as an inwardly extending finger of socket barrel article 152. A forward end 192 of pin contact section 194 enters lead-in 162, engages cap member 184 and compresses spring 182 allowing spring contact arm 170 to tend to move inwardly until it engages side 196 of pin contact section 194. Upon withdrawal of pin contact section 194 from socket cavity 164, spring 182 urges forward cap member 184 until it resumes its bracing engagement position proximate contact surface 178 of spring contact arm 170, holding arm 170 in a spring-biased position away from opposing cooperating surface 168, ready for lower insertion force insertion of a pin terminal 190.

Figure 12:
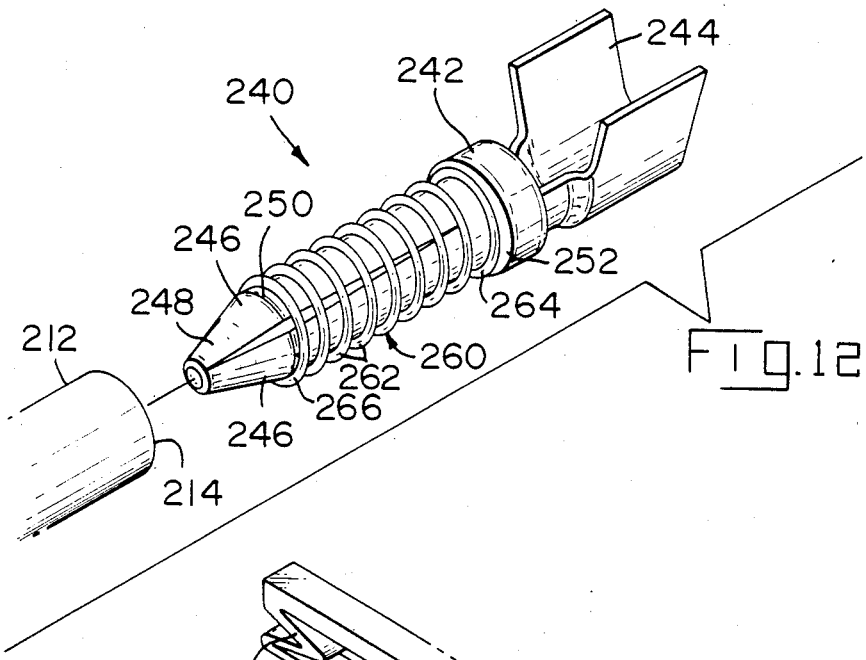
FIG. 12 is a perspective view of an active pin terminal with a coil spring passive cam follower therearound, for insertion into a barrel of a socket terminal.

An active pin terminal 240 is shown in FIG. 12 having a body section 242, a conductor-receiving section 244 (crimpable around a stripped end of a wire conductor), spring contact arms 246 (forming a pin section), and a forward frustoconical end 248. The pin section is insertable into the socket barrel 212 of a socket terminal (not shown). A coil compression spring 260 (the passive cam follower) having coils 262 is shown disposed around spring contact arms 246 in an extended or relatively uncompressed state with forward end 266 (bracing means) urging spring contact arms 246 inward into a biased position proximate initial engagement points 250. A rearward end 264 of spring 260 is secured or held against a stop shoulder 252 of body section 242 of active pin terminal 240.

In FIG. 12, as forward end 248 of active pin terminal 240 is inserted into socket barrel 212, forward end 214 of the barrel engages forward end 266 of coil spring 260 and urges coil spring 260 into a compressed state. When spring contact arms 246 are released by forward spring end 266, they engage inside contact surfaces of socket barrel 212 and frictionally slide therealong until the pin section is fully inserted, and coil spring 260 is compressed. When active pin terminal 240 is withdrawn from socket barrel 212, coil spring 260 will begin extending forward and will resume its relatively uncompressed length as shown in FIG. 12 and again holding together spring contact arms 246. Forward spring end 266 (the bracing means) may consist of one coil 262 or several closely-spaced coils 262 having an inner diameter substantially equal to the inner diameter of socket barrel 212, or an annular collar member (not shown) may be secured to the forward end of the coil spring.

The passive cam follower of the present invention may be used in a variety of discrete terminals having a single spring contact arm or a plurality of cooperating spring contact arms, whether they be spring biased inward or outward, and whether the terminals be active pins or active sockets and whether the terminals be round or slotted. The compression strength of the compression means need only be sufficient to urge a bracing means forward along the spring contact arms as a mating terminal is withdrawn, which arms are still in a biased position. Thus the cam follower is termed "passive" in that the cam follower is not required to urge the contact arms apart in an active socket or receptacle terminal, or together in an active pin terminal, but only to hold them apart or together respectively whey they have already been placed in a biased position.

Figure 13:
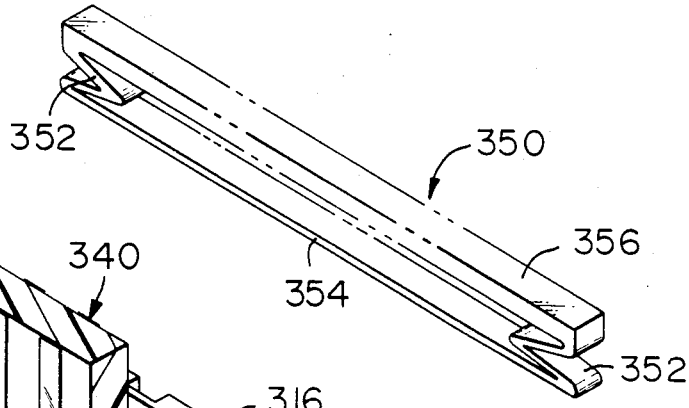
FIG. 13 is a perspective view of an integral molded plastic passive cam follower for use in card edge connectors.
Figure 14:
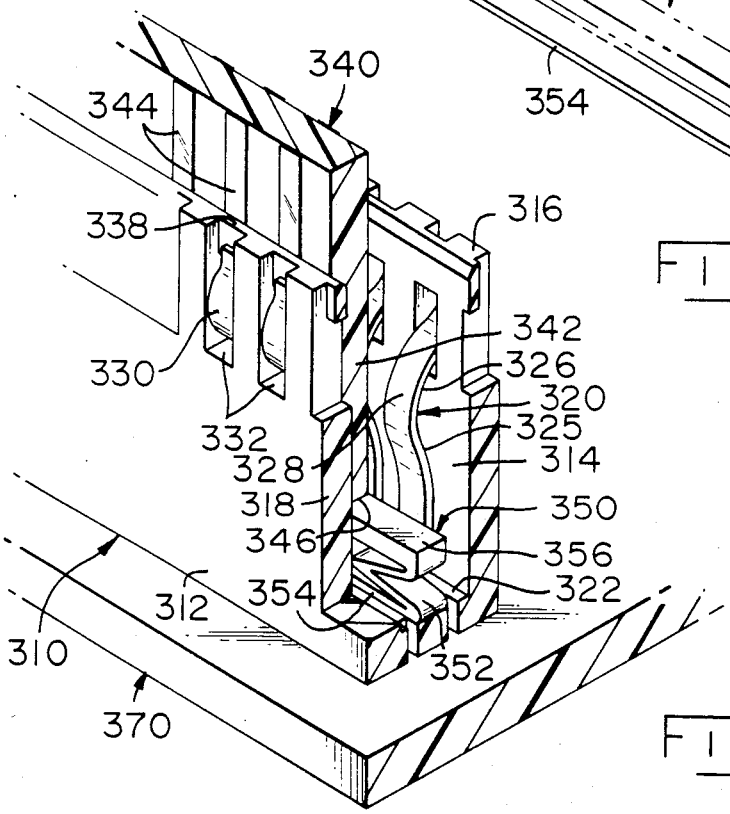
FIG. 14 is a perspective section view of a card edge connector with the passive cam follower of FIG. 13 therein, and a card edge inserted thereinto.

The passive cam follower of the present invention is useful in electrical connectors, such as card edge connectors like connector 310 shown in FIGS. 14, 15 and 16. FIG. 13 illustrates a preferred embodiment of passive cam follower comprising an integral molded plastic spring 350 of polyetherimide, for example. Spring 350 has a longitudinal cap section 356 which is the bracing means, compression spring sections 352 integral therewith at each end of spring 350 extending first inwardly toward each other and then ouwardly, and an integral longitudinal base section 354. An alternative embodiment would be an integral metal spring of stainless steel, for example, of similar configuration, with a polyetherimide cap member secured to the top. The metal may be coated with an epoxy material.

A card edge connector 310 comprises a housing 312 having a longitudinal card-receiving central cavity 314 extending inward from a top surface 316 of housing 312 between parallel sidewalls 318 and endwalls (not shown), to receive an edge portion 342 of a printed circuit card 340 therein. Two rows of paired opposing electrical contacts 320 are spaced along sides of card-receiving cavity 314 and secured to housing 312 at the bottom 322 of cavity 314 with lower contact sections 324 extending outward below housing 312 for electrical engagement with, for example, plated through-holes 372 of a mother printed circuit board 370, as shown in FIG. 15.

FIG. 15 illustrates connector 310 without a passive cam follower therein. Contacts 320 extend upward from cavity bottom 322, then have sections 325 extending slightly inwardly, and then have arcuate spring contact arm sections 326 extending substantially inwardly into cavity 314 toward a central plane longitudinally therethrough such that contact surfaces 328 thereon would engage respective conductors 344 on side surfaces of edge portion 342 of a card 340 inserted therein. Contacts 320 further have diverging sections 330 proximate top housing surface 316 which extend out of card-receiving cavity 314 and into apertures 332 in housing sidewalls 318 ending in end sections 334 which are disposed outwardly of stop surfaces 336 of bridges 338 extending across the tops of apertures 332 adjacent top surface 316 of housing 312.

Referring back to FIG. 14, the passive cam follower 350 of FIG. 13 is contained within card-receiving cavity 314 with base section 354 adjacent cavity bottom 322. When in position holding apart spring contact arm sections 326, cap section 356 is preferably disposed along contact sections 325 just below arcuate spring contact arm sections 326. Thus when edge portion 342 of card 340 is inserted into card-receiving cavity 314 its conductors 344 are frictionally engaged by contact surfaces 328 but arcuate spring contact arm sections 326 are already in a biased parted position by cap section 356. When leading edge surface 346 engages cap section 356, compression sections 352 are compressed and cap section 356 is pushed downward, allowing spring contact arm sections 328 to apply their designed contact force against conductors 344. When card 340 is withdrawn, cap section 356 follows edge surface 346 until engaging converging contact sections 325 and maintains spring contact arm sections 326 in a biased parted position until a card edge is next inserted.

The width of cap section 356 should be preferably no greater than the distance between opposing contacts 320 at bottom 322 of cavity 314, and not less than the thickness of card edge 342. The actual width of cap section 356 should be selected to cooperate with an opposing pair of contacts 320 when unbiased, and in particular with the distance between converging contact sections 325 of opposing contacts 320.

As shown in FIGS. 16 and 17, an alternate embodiment of a passive cam follower 360 of the present invention is disposed within card-receiving cavity 314 proximate bottom 322 thereof and between the rows of contacts 320. Passive cam follower 360 is comprised of a compression means, a plurality of longitudinally spaced coil compression springs 362; a stop means, bottom ends 364 of springs 362 secured to cavity bottom 322 (cooperating stop means); and a bracing means, a cap member 366 secured to forward ends 368 of the coil springs 362 and extending along cavity 314 axially normally to contacts 320. Cap member 366 may be made of dielectric material such as plastic, and may optionally have either shallow recesses (not shown) in which at least a first coil at forward spring end 368 is secured, or short projections 370 depending from the bottom thereof dimensioned to just fit inside at least a first coil at forward spring ends 368, or both. Guide pins 372 preferably are disposed along cavity bottom 322, and project upward within coils at bottom spring ends 364 to maintain coil springs 362 in place and in a proper upward orientation within card-receiving cavity 314.

Another embodiment of passive cam follower for use in a card edge connector 310 comprises a plurality of spaced compression springs (either coil springs or molded plastic springs) secured to the bottom of the card-receiving cavity with a plurality of aligned cap members (not shown) rather than a single cap member 366. For instance, a selected pair of opposing contacts may be desired to be not cammed apart such as those used as power and/or ground contacts which may work best if they apply substantial contact force against associated conductors of a card edge to establish an immediate high integrity electrical connection. (Further in this regard the associated conductors may be extended to the end surface 346 of card edge portion 342 for immediate contact, and all other conductors not extend completely to the end surface.) Therefore, a cap member would not be disposed between the selected pair of contacts, but cap members for the other contacts beginning on either side of the selected pair would be used. Also, each pair of contacts or each group of consecutive pairs, may have its own passive cam follower comprising a cap member, if desired, and a spring, or springs respectively, therefore.

A passive cam follower of appropriate design may be used with an electrical connector (not shown) wherein pairs of opposing spring contact arms are contained within individual passageways of the connector housing forming discrete receptacle members and having discrete passive cam followers such as those of FIGS. 6 and 7.

In FIG. 18 is shown a card edge connector 410 useful for a single sided card edge 440, that is, one having conductors 444 on only one surface thereof. A useful connector could comprise a housing 412 having unopposed contacts 420 each having an arcuate spring contact arm section 426 disposed within card-receiving cavity 414 near or engaging surface 419 of cavity wall 418, with an edge portion 442 of card 440 insertable therebetween. An integral molded plastic passive cam follower 450 such as that shown in FIG. 13 may be secured along cavity bottom 422 extending upwardly. A cap section 456 holds spring contact arms 426 in a spring biased position further away from surface 419 of cavity wall 418 (cooperating surface means) for low insertion force reception of card edge portion 442.

It can be seen that the passive cam follower of the present invention may be used in association with a single spring contact arm and a cooperating surface means such as a substantially parallel cavity wall of a conector housing, along which the bracing means would move.

Similar in cross-section to FIG. 18, a multi-cavity receptacle connector (not shown) could utilize a plurality of single spring contact arms and an opposing cooperating cavity wall to receive a post terminal or blade-like terminal therein, with a discrete passive cam follower therebetween, such as those of FIGS. 6 and 7.

It also foreseeable to utilize the passive cam follower of the present invention with an electrical connector having individual pin terminals having contact sections formed of normally diverging discrete spring contact arms, where the passive cam follower would comprise a bracing means disposed outside of and along the arms, holding them together. Also, where the pin contact arms are contained entirely within a discrete cavity of a housing the bracing means may consist of separate but cooperating members disposed between a wall of the housing cavity and the pin contacting arm, each having its own compression means and being simultaneously urgeable into compression upon insertion of socket contact sections around and along the pin contact arms.

Although the passive cam follower has been described with respect to several particular embodiments thereof, many changes and modifications may become apparent to those skilled in the art without departing from the spirit and scope of the invention. It is therefore intended that all such changes and modifications be included within the scope of the patent as may reasonably and properly be included within the scope of the contribution to the art.

What is claimed is:

1. A passive cam follower means associated with a first electrical article where said first article has a body portion, a mating axis, at least one contact section means capable of being spring biased normally to said mating axis, and a cooperating surface means spaced laterally from said at least one contact section means and associated therewith, where said at least one contact section means has a contact surface for electrical engagement with associated contact surface means of a second electrical article in an axial mating procedure requiring insertion force, wherein:

said passive cam follower means comprises a bracing means, a stop means and a compression means between said bracing means and said stop means;

said compression means has a low compression strength;

said stop means is disposed in stopping engagement axially with respect to said body portion;

said compression means is disposed along the mating axis and is compressible by said second electrical article during said axial mating;

said bracing means is disposed in a position adjacent to and in bracing engagement with said at least one contact section means proximate said contact surface thereof and said cooperating surface means to hold said contact section means substantially in a preselected spring-biased position in relationship to said cooperating surface means when said first electrical article is not in mated engagement with said second electrical article, said position being substantially equivalent to the position of said at least one contact section means when said first article and said second article are fully mated, whereby said mating requires substantially less insertion force.

2. An improved electrical article including a body portion, a mating axis, at least one contact section means capable of being spring biased normally to said mating axis, and a cooperating surface means spaced laterally from said at least one contact section means and associated therewith, where said at least one contact section means has a contact surface for electrical engagement with associated contact surface means of a second electrical article in an axial mating procedure requiring insertion force, the improvement comprising:

a passive cam follower means having a bracing means, a stop means and a compression means between said bracing means and said stop means;

said compression means has a low compression strength;

said stop means is disposed in stopping engagement axially with respect to said body portion;

said compression means is disposed along the mating axis and is compressible by said second electrical article during said axial mating; and said bracing means is disposed in a position adjacent to and in bracing engagement with said at least one contact section means proximate said surface thereof and said cooperating surface means to hold said contact section means substantially in a preselected spring-biased position in relationship to said cooperating surface means when said electrical article is not in mated engagement with said second electrical article, said position being substantially equivalent to the position of said at least one contact means when said electrical article and said second electrical article are fully mated, whereby said mating requires substantially less insertion force.

3. An electrical connector having a plurality of first electrical terminals secured in a dielectric housing means for axially matable electrical engagement with second electrical terminals, said first electrical terminals having contact section means each having a contact surface thereon to electrically engage an associated contact surface means of said second electrical terminals, characterized in that:

a cooperating surface means is associated with and spaced laterally from each said contact section means;

each said contact section means is capable of being spring biased normally to the mating axis of a respective said first electrical terminal;

each said first electrical terminal has associated therewith a passive cam follower comprising a bracing means, a stop means and a compression means between said bracing means and said stop means, said compression means having a low compression strength, and said stop means being disposed in stopping engagement with a cooperating stop means of said first electrical terminal;

said compression means of a respective said passive cam follower is disposed along the mating axis of said first electrical terminal and is compressible by said second electrical terminal during said axial mating; and said bracing means of a respective said passive cam follower is disposed in a position adjacent to and in bracing engagement with the respective contact section means of a respective said first electrical terminal proximate said contact surface thereof and said cooperating surface means associated therewith, to hold said contact section means substantially in a preselected spring-biased position in relationship to said associated cooperating surface means when said respective first electrical terminal is not in mated engagement with said second electrical terminal, said position being substantially equivalent to the position of said contact section means when said first and said second electrical terminals are fully mated, whereby said mating requires substantially less insertion force.

* * * * *